US009886930B2

(12) United States Patent
Tang

(10) Patent No.: US 9,886,930 B2
(45) Date of Patent: Feb. 6, 2018

(54) CONTROL CIRCUIT AND DISPLAY DEVICE

(71) Applicant: Wuhan China Star Optoelectronics Technology Co., Ltd., Wuhan, Hubei (CN)

(72) Inventor: Yuejun Tang, Guangdong (CN)

(73) Assignee: Wuhan China Star Optoelectronics Technology Co., Ltd., Wuhan, Huhei (CN)

( * ) Notice: Subject to any disclaimer, the term of this patent is extended or adjusted under 35 U.S.C. 154(b) by 164 days.

(21) Appl. No.: 14/893,864

(22) PCT Filed: Jun. 30, 2015

(86) PCT No.: PCT/CN2015/082735

§ 371 (c)(1),
(2) Date: Nov. 24, 2015

(87) PCT Pub. No.: WO2016/176901

PCT Pub. Date: Nov. 10, 2016

(65) Prior Publication Data

US 2017/0098423 A1 Apr. 6, 2017

(30) Foreign Application Priority Data

May 7, 2015 (CN) ..... 2015 1 0229355

(51) Int. Cl.
*G09G 3/36* (2006.01)

(52) U.S. Cl.
CPC ... *G09G 3/3688* (2013.01); *G09G 2320/0233* (2013.01)

(58) Field of Classification Search
CPC ..... G09G 3/3688; G09G 2320/0233
USPC ..... 345/98, 100, 89, 204, 87, 211, 103, 101, 345/90, 95, 80; 349/143; 368/84; 700/15
See application file for complete search history.

(56) References Cited

U.S. PATENT DOCUMENTS

2003/0117356 A1* 6/2003 Moon ..... G02F 1/13452 345/87
2008/0224982 A1* 9/2008 Yamazaki ..... G09G 3/3688 345/98

FOREIGN PATENT DOCUMENTS

| | | | |
|---|---|---|---|
| CN | 101510017 | A | 8/2009 |
| CN | 101944337 | A | 1/2011 |
| CN | 102314011 | A | 1/2012 |
| CN | 103337233 | A | 10/2013 |
| CN | 104076544 | A | 10/2014 |

* cited by examiner

*Primary Examiner* — Alexander Eisen
*Assistant Examiner* — Mansour M Said
(74) *Attorney, Agent, or Firm* — Andrew C. Cheng

(57) ABSTRACT

Disclosed is a drive control circuit, comprising a driver, a pixel array and a resistor, and the pixel array comprises M×N pixels, and M is a natural number larger than 1, and N is a natural number, and the driver is coupled to the N columns pixels through the resistor, and the resistor comprises a first resistor and a second resistor, and a resistance of the first resistor is larger than a resistance of the second resistor, and an area surrounded by the pixel array is divided into a first area and a second area, and the first area and the second area comprise at least one row pixels, and a length of a connection line of the driver with any row pixels in the first area is smaller than a length of a connection line of the driver with any row pixels in the second area.

9 Claims, 3 Drawing Sheets

CONTROL CIRCUIT AND DISPLAY DEVICE

CROSS REFERENCE

This application claims the priority of Chinese Patent Application No. 201510229355.2, entitled "Control circuit and display device", filed on May 7, 2015, the disclosure of which is incorporated herein by reference in its entirety.

FIELD OF THE INVENTION

The present invention relates to an electronic technology field, and more particularly to a control circuit and a display device.

BACKGROUND OF THE INVENTION

In display devices, the connection lines are formed among the output channels of the source driver and the data lines of the pixel array for respectively coupling the output channels of the source driver with the data lines. The data signal outputted by the output channels of the source driver is transmitted from the first row to the last row of the pixel array. The connection line is longer, and the resistance of the line is larger. The voltage charge quantity of the liquid crystal units in the pixel array changes according to the resistances of the lines. The voltage charge quantity of the liquid crystal unit coupled to the data line with large line resistance is smaller than the voltage charge quantity of the liquid crystal unit coupled to the data line with relatively smaller line resistance. Because the voltage charge quantity of the liquid crystal unit varies with the change of the connection line resistance, the display image of the display device has nonuniform defects.

SUMMARY OF THE INVENTION

An objective of the present invention is to provide a control circuit and display device to enforce the uniformity of the display image of the display device.

For realizing the aforesaid objective, the technical solution provided by the embodiments of the present invention is:

The present invention provides a drive control circuit, comprising a driver, a pixel array and a resistor, and the pixel array comprises M×N pixels aligned in a form M rows×N columns, and M is a natural number larger than 1, and N is a natural number, and the driver is coupled to the N columns pixels of the pixel array through the resistor to charge the N columns pixels, and the resistor comprises a first resistor and a second resistor, and a resistance of the first resistor is larger than a resistance of the second resistor, and an area surrounded by the pixel array is divided into a first area and a second area, and both the first area and the second area comprise at least one row pixels, and a length of a connection line of the driver with any row pixels in the first area is smaller than a length of a connection line of the driver with any row pixels in the second area, and when the driver determines that it is required to sequentially supply power to each row pixels of the first area, the first resistor is activated to make a power supply signal outputted by the driver pass through the first resistor and be sequentially outputted to each row pixels of the first area for sequentially supplying power to the each row pixels of the first area, and when the driver determines that it is required to sequentially supply power to each row pixels of the second area, the second resistor is activated to make the power supply signal outputted by the driver pass through the second resistor and be sequentially outputted to each row pixels of the second area for sequentially supplying power to the each row pixels of the second area to balance charge quantity of the each row pixels.

The pixel array further comprises R×N pixels aligned in a form R rows×N columns, and the R×N pixels are aligned under the M×N pixels to construct a pixel array of M+R rows×N columns, and the R×N pixels surround a third area, and R is a natural number larger than 1, and a length of a connection line of the driver with any row pixels in the third area is larger than the length of the connection line of the driver with any row pixels in the second area, and the resistor further comprises a third resistor, and a resistance of the third resistor is smaller than the resistance of the second resistor, and when the driver determines that it is required to sequentially supply power to each row pixels of the third area, the third resistor is activated to make the power supply signal outputted by the driver pass through the third resistor and be sequentially outputted to each row pixels of the third area for sequentially supplying power to the each row pixels of the third area to balance charge quantity of the each row pixels in the pixel array of (M+R) rows×N columns.

A length in the first area of the lines of the driver coupling to the first to the M+Rth row pixels through the resistors is equal to a length in the second area of the lines of the driver coupling to the first to the M+Rth row pixels through the resistors and a length in the third area of the lines of the driver coupling to the first to the M+Rth row pixels through the resistors.

An amount of the resistor is one.

An amount of the resistors is N, and each column pixels are coupled to the driver through one resistor, and the resistances of the first resistors in the N resistors are equal, and the resistances of the second resistors in the N resistors are equal, and the resistances of the third resistors in the N resistors are equal.

All the resistances of the first resistors, the second resistors and the third resistors in the N resistors are gradually increased from the first column and the Nth column respectively to a middle position.

The N columns pixels are symmetric with the pixel array of (M+R) rows×N columns being a central line, and two first resistors coupled with two columns pixels which are mutually symmetric are equal, and two second resistors coupled with the two columns pixels which are mutually symmetric are equal, and two third resistors coupled with the two columns pixels which are mutually symmetric are equal.

The present invention further provides a display device, comprising a driver, a display panel, a pixel array and a resistor, and the pixel array comprises M×N pixels aligned in a form M rows×N columns, and M is a natural number larger than 1, and N is a natural number, and the driver is coupled to the N columns pixels of the pixel array through the resistor to charge the N columns pixels, and the resistor comprises a first resistor and a second resistor, and a resistance of the first resistor is larger than a resistance of the second resistor, and an area surrounded by the pixel array is divided into a first area and a second area, and both the first area and the second area comprise at least one row pixels, and a length of a connection line of the driver with any row pixels in the first area is smaller than a length of a connection line of the driver with any row pixels in the second area, and when the driver determines that it is required to sequentially supply power to each row pixels of the first area, the first resistor is activated to make a power supply signal outputted by the driver pass through the first resistor and be sequentially outputted to each row pixels of the first area for sequentially supplying power to the each row pixels of the first area, and when the driver determines that it is required to sequentially supply power to each row pixels of the second area, the second resistor is activated to make the power supply signal outputted by the driver pass through the second resistor and be sequentially outputted to each row pixels of the second area for sequentially supplying power to the each row pixels of the second area to balance charge quantity of the each row pixels.

The pixel array further comprises R×N pixels aligned in a form R rows×N columns, and the R×N pixels are aligned under the M×N pixels to construct a pixel array of M+R rows×N columns, and the R×N pixels surround a third area, and R is a natural number larger than 1, and a length of a connection line of the driver with any row pixels in the third area is larger than the length of the connection line of the driver with any row pixels in the second area, and the resistor further comprises a third resistor, and a resistance of the third resistor is smaller than the resistance of the second resistor, and when the driver determines that it is required to sequentially supply power to each row pixels of the third area, the third resistor is activated to make the power supply signal outputted by the driver pass through the third resistor and be sequentially outputted to each row pixels of the third area for sequentially supplying power to the each row pixels of the third area to balance charge quantity of the each row pixels in the pixel array of (M+R) rows×N columns.

A length in the first area of the lines of the driver coupling to the first to the M+Rth row pixels through the resistors is equal to a length in the second area of the lines of the driver coupling to the first to the M+Rth row pixels through the resistors and a length in the third area of the lines of the driver coupling to the first to the M+Rth row pixels through the resistors.

An amount of the resistor is one.

An amount of the resistors is N, and each column pixels are coupled to the driver through one resistor, and the resistances of the first resistors in the N resistors are equal, and the resistances of the second resistors in the N resistors are equal, and the resistances of the third resistors in the N resistors are equal.

All the resistances of the first resistors, the second resistors and the third resistors in the N resistors are gradually increased from the first column and the Nth column respectively to a middle position.

The N columns pixels are symmetric with the pixel array of (M+R) rows×N columns being a central line, and two first resistors coupled with two columns pixels which are mutually symmetric are equal, and two second resistors coupled with the two columns pixels which are mutually symmetric are equal, and two third resistors coupled with the two columns pixels which are mutually symmetric are equal.

The driver of the present invention needs to charge each row pixels of the pixel array. Because the pixel array comprises a plurality of rows of pixels, the plurality of rows of pixels are sequentially aligned in a form of array to be arranged under the driver. The distances of the different rows of pixels with the driver are different. The lengths of the connection lines of the driver with each row pixels are different. Meanwhile, with the distance between the row of the pixels and the driver gets larger and larger, the length of the connection line of the driver with the corresponding row of the pixels also gets longer and longer. The longer the connection is, the larger the connection resistance is, too. Thus, the charging quantity of the driver to the corresponding row of pixels is smaller. Consequently, the charge quantity to the entire pixel array is not even. The display brightness of the entire pixel array becomes uneven. The drive control circuit of the present invention comprises a resistor. The driver is coupled to the N columns pixels of the pixel array through the resistor to charge the N columns pixels. The resistor comprises a first resistor and a second resistor. An area surrounded by the pixel array is divided into a first area and a second area. Both the first area and the second area comprise at least one row pixels. A length of a connection line of the driver with any row pixels in the first area is smaller than a length of a connection line of the driver with any row pixels in the second area. When the driver determines that it is required to sequentially supply power to each row pixels of the first area, the first resistor is activated to make a power supply signal outputted by the driver pass through the first resistor and be sequentially outputted to each row pixels of the first area for sequentially supplying power to the each row pixels of the first area. When the driver determines that it is required to sequentially supply power to each row pixels of the second area, the second resistor is activated to make the power supply signal outputted by the driver pass through the second resistor and be sequentially outputted to each row pixels of the second area for sequentially supplying power to the each row pixels of the second area. Because the resistance of the first resistor is larger than the resistance of the second resistor, the first total resistance (a sum of the corresponding line resistance and the first resistor) of the lines of the driver with the pixels in the first area and the second total resistance (a sum of the corresponding line resistance and the second resistor) of the lines of the driver with the pixels in the second area are balanced. Thus, the charge quantity of the driver to the corresponding row pixels is balanced. Therefore, the display brightness of the entire pixel array is balanced.

BRIEF DESCRIPTION OF THE DRAWINGS

In order to more clearly illustrate the embodiments of the present invention, the following figures will be described in the embodiments are briefly introduced. It is obvious that the drawings are only some embodiments of the present invention, those of ordinary skill in this field can obtain other figures according to these figures without paying the premise.

DETAILED DESCRIPTION OF PREFERRED EMBODIMENTS

For better explaining the technical solution and the effect of the present invention, the present invention will be further described in detail with the accompanying drawings in the specific embodiments.

Figure 1:
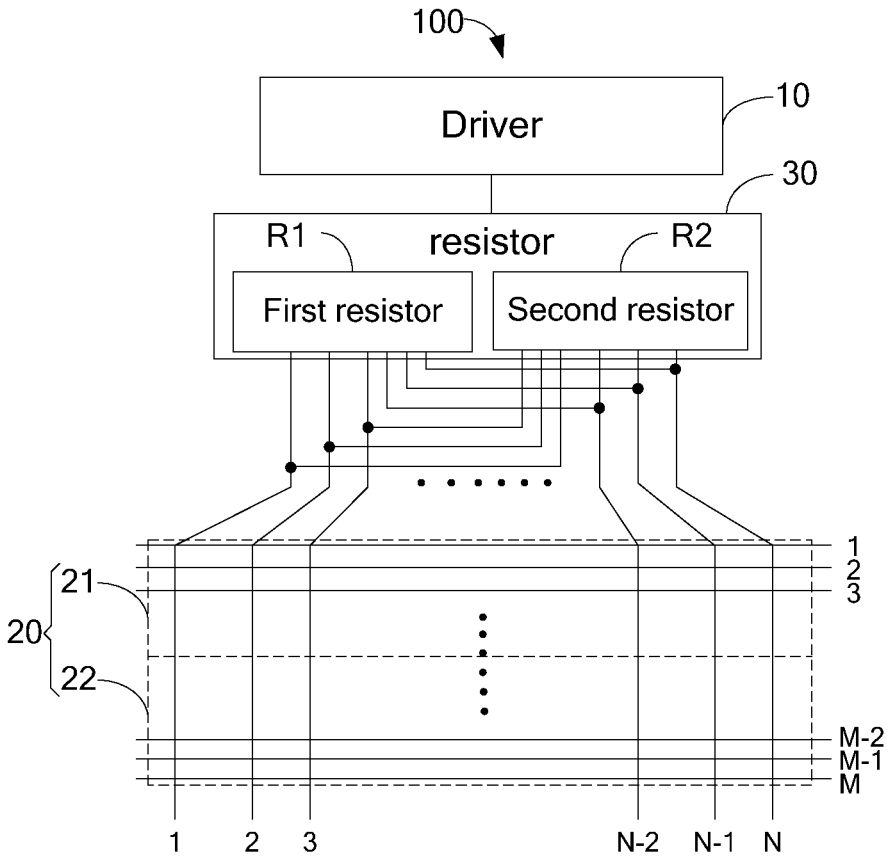
FIG. 1 is a block diagram of a drive control circuit provide by the first embodiment of the first solution according to the present invention.

Please refer to FIG. 1. The first embodiment of the first solution according to the present invention provides a drive control circuit 100. The drive control circuit 100 comprises a driver 10, a pixel array 20 and a resistor 30. The pixel array 20 comprises M×N pixels (not shown) aligned in a form M rows×N columns, wherein M is a natural number larger than 1, and N is a natural number. The driver 10 is coupled to the N columns pixels of the pixel array 20 through the resistor 30 to charge the N columns pixels. The resistor 30 comprises a first resistor R1 and a second resistor R2. A resistance of the first resistor R1 is larger than a resistance of the second resistor R2. An area surrounded by the pixel array 20 is divided into a first area 21 and a second area 22. Both the first area 21 and the second area 22 comprise at least one row pixels. A length of a connection line of the driver 10 with any row pixels in the first area 21 is smaller than a length of a connection line of the driver 10 with any row pixels in the second area 22. When the driver 10 determines that it is required to sequentially supply power to each row pixels of the first area, the first resistor R1 is activated to make a power supply signal outputted by the driver 10 pass through the first resistor R1 and be sequentially outputted to each row pixels of the first area 21 for sequentially supplying power to the each row pixels of the first area 21. when the driver 10 determines that it is required to sequentially supply power to each row pixels of the second area 22, the second resistor R2 is activated to make the power supply signal pass through the second resistor R2 and be sequentially outputted to each row pixels of the second area 22 for sequentially supplying power to the each row pixels of the second area 22 to balance charge quantity of the each row pixels.

Specifically, a first predetermined interval and a second predetermined interval are recorded in the driver 10, wherein the second predetermined interval is equal to the first predetermined interval multiply by row number of the pixels in the first area 21. After the display device is powered on, the driver 10 determines that it is required to charge a plurality of rows of pixels in the first area 21. First, the driver 10 automatically charges the first row pixels in the first area 21 through the first resistor R1, and times. After reaching the first predetermined interval, the second row pixels in the first area 21 is charged simultaneously right after the charge to the first row pixels in the first area 21 is stopped, and so on. In every first predetermined interval, the next row pixels are charged right after the charge to the present row pixel is stopped. After the last row pixels in the first area 21 are charged in the first predetermined interval, then, the driver 10 recognizes that the second predetermined interval is reached. The driver 10 determines that it is required to charge a plurality of rows of pixels in the second area 22. The driver 10 activates the second resistor R2 and charges the plurality of rows of pixels in the second area 22 through the second resistor R2, and times. After reaching the first predetermined interval, the second row pixels in the second area 22 is charged simultaneously right after the charge to the first row pixels in the second area 22 is stopped, and so on. In every first predetermined interval, the next row pixels are charged right after the charge to the present row pixel is stopped. After the last row pixels in the second area 22 are charged in the first predetermined interval, one charge cycle to the pixel array 20 is accomplished.

In this embodiment, an amount of the resistor 30 is one. The first resistor R1 and the second resistor R2 are connected in parallel.

The driver 10 is required to charge each row pixels of the pixel array 20. Because the pixel array 20 comprises a plurality of rows of pixels. The plurality of rows of pixels are sequentially aligned in a form of array to be arranged under the driver 10. The distances of the different rows of pixels with the driver 10 are different. The lengths of the connection lines of the driver 10 with each row pixels are different. Meanwhile, with the distance between the row of the pixels and the driver 10 gets larger and larger, the length of the connection line of the driver 10 with the corresponding row of the pixels also gets longer and longer. The longer the connection is, the larger the connection resistance is, too. Thus, the charging quantity of the driver 10 to the corresponding row of pixels is smaller. Consequently, the charge quantity to the entire pixel array 20 is not even. The display brightness of the entire pixel array 20 becomes uneven. In this embodiment, the drive control circuit 100 comprises a resistor 30. The driver 10 is coupled to the N columns pixels of the pixel array 20 through the resistor 30 to charge the N columns pixels. The resistor 30 comprises a first resistor R1 and a second resistor R2. An area surrounded by the pixel array 20 is divided into a first area 21 and a second area 22. Both the first area 21 and the second area 22 comprise at least one row pixels. A length of a connection line of the driver 10 with any row pixels in the first area 21 is smaller than a length of a connection line of the driver 10 with any row pixels in the second area 22. When the driver 10 determines that it is required to sequentially supply power to each row pixels of the first area, the first resistor R1 is activated to make a power supply signal outputted by the driver 10 pass through the first resistor R1 and be sequentially outputted to each row pixels of the first area 21 for sequentially supplying power to the each row pixels of the first area 21. when the driver 10 determines that it is required to sequentially supply power to each row pixels of the second area 22, the second resistor R2 is activated to make the power supply signal pass through the second resistor R2 and be sequentially outputted to each row pixels of the second area 22 for sequentially supplying power to the each row pixels of the second area 22. Because the resistance of the first resistor R1 is larger than the resistance of the second resistor R2, the first total resistance (a sum of the corresponding line resistance and the first resistor) of the lines of the driver 10 with the pixels in the first area 21 and the second total resistance (a sum of the corresponding line resistance and the second resistor) of the lines of the driver 10 with the pixels in the second area 22 are balanced. Thus, the charge quantity of the driver 10 to the corresponding row pixels is balanced. Therefore, the display brightness of the entire pixel array 20 is balanced.

Figure 2:
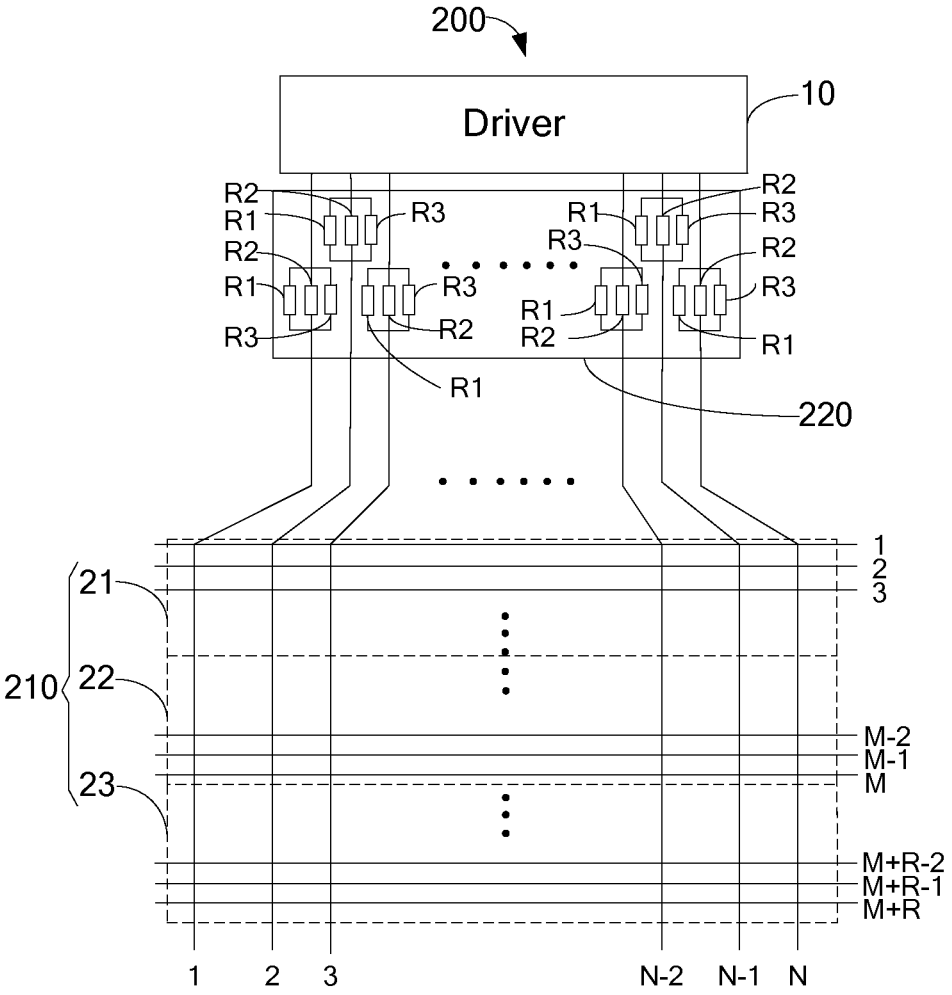
FIG. 2 is a block diagram of a drive control circuit provide by the second embodiment of the first solution according to the present invention.

Please refer to FIG. 2. The second embodiment of the present invention provides a drive control circuit 200. The drive control circuit 200 provided by the second embodiment is similar with the drive control circuit 100 provided by the first embodiment. The difference between the two is: in the second embodiment, the pixel array 210 further comprises R×N pixels aligned in a form R rows×N columns. The R×N pixels are aligned under the M×N pixels to construct a pixel array of M+R rows×N columns. The R×N pixels surround a third area 23, wherein R is a natural number larger than 1. A length of a connection line of the driver 10 with any row pixels in the third area 23 is larger than a length of a connection line of the driver 10 with any row pixels in the second area 22. The resistor 220 further comprises a third resistor R3. A resistance of the third resistor R3 is smaller than the resistance of the second resistor R2, and when the driver 10 determines that it is required to sequentially supply power to each row pixels of the third area 23, the third resistor R3 is activated to make the power supply signal outputted by the driver 10 pass through the third resistor R3 and be sequentially outputted to each row pixels of the third area for sequentially supplying power to the each row pixels of the third area 23 to balance charge quantity of the each row pixels in the pixel array 210 of (M+R) rows×N columns.

Specifically, a third predetermined interval is recorded in the driver 10, wherein the third predetermined interval is equal to the first predetermined interval multiply by row number of the pixels in the second area 22. After the last row pixels in the second area 22 are charged in the first predetermined interval, then, the driver 10 recognizes that the third predetermined interval is reached. The driver 10 determines that it is required to charge a plurality of rows of pixels in the third area 23. The driver 10 activates the third resistor R3, and charges the first row pixels in the third area 23 through the third resistor R3, and times. After reaching the first predetermined interval, the second row pixels in the third area 23 is charged simultaneously right after the charge to the first row pixels in the third area 23 is stopped, and so on. In every first predetermined interval, the next row pixels are charged right after the charge to the present row pixel is stopped. After the last row pixels in the third area 23 are charged in the first predetermined interval, one charge cycle to the pixel array 210 is accomplished.

The first resistor R1, the second resistor R2 and the third resistor R3 in each resistor 220 are connected in parallel.

In this embodiment, the driver 10 is required to charge each row pixels of the pixel array 210. Because the pixel array 210 comprises a plurality of rows of pixels, the plurality of rows of pixels are sequentially aligned in a form of array to be arranged under the driver 10. The distances of the different rows of pixels with the driver 10 are different. The lengths of the connection lines of the driver 10 with each row pixels are different. Meanwhile, with the distance between the row of the pixels and the driver 10 gets larger and larger, the length of the connection line of the driver 10 with the corresponding row of the pixels also gets longer and longer. The longer the connection is, the larger the connection resistance is, too. Thus, the charging quantity of the driver 10 to the corresponding row of pixels is smaller. Consequently, the charge quantity to the entire pixel array 20 is not even. The display brightness of the entire pixel array 20 becomes uneven. In this embodiment, the drive control circuit 100 comprises a resistor 30. The driver 10 is coupled to the N columns pixels of the pixel array 210 through the resistor 30 to charge the N columns pixels. The resistor 30 comprises a first resistor R1, a second resistor R2 and a third resistor R3. An area surrounded by the pixel array 20 is divided into a first area 21, a second area 22 and a third area 23. A length of a connection line of the driver 10 with any row pixels in the first area 21 is smaller than a length of a connection line of the driver 10 with any row pixels in the second area 22. A length of a connection line of the driver 10 with any row pixels in the second area 22 is smaller than a length of a connection line of the driver 10 with any row pixels in the third area 23. When the driver 10 determines that it is required to sequentially supply power to each row pixels of the first area, the first resistor R1 is activated to make a power supply signal outputted by the driver 10 pass through the first resistor R1 and be sequentially outputted to each row pixels of the first area 21 for sequentially supplying power to the each row pixels of the first area 21. when the driver 10 determines that it is required to sequentially supply power to each row pixels of the second area 22, the second resistor R2 is activated to make the power supply signal pass through the second resistor R2 and be sequentially outputted to each row pixels of the second area 22 for sequentially supplying power to the each row pixels of the second area 22. when the driver 10 determines that it is required to sequentially supply power to each row pixels of the third area 23, the third resistor R3 is activated to make the power supply signal pass through the third resistor R3 and be sequentially outputted to each row pixels of the third area 23 for sequentially supplying power to the each row pixels of the third area 23. Because the resistance of the first resistor R1 is larger than the resistance of the second resistor R2 and the resistance of the second resistor R2 is larger than the resistance of the third resistor R3, the first total resistance (a sum of the corresponding line resistance and the first resistor R1) of the lines of the driver 10 with the pixels in the first area 21 and the second total resistance (a sum of the corresponding line resistance and the second resistor R2) of the lines of the driver 10 with the pixels in the second area 22, the third total resistance (a sum of the corresponding line resistance and the third resistor R3) of the lines of the driver 10 with the pixels in the third area 23 are balanced. Thus, the charge quantity of the driver 10 to the pixels of the pixel array 210 is balanced. Therefore, the display brightness of the entire pixel array 210 is balanced.

Furthermore, a length in the first area 21 of the lines of the driver 10 coupling to the first to the M+Rth row pixels through the resistors 220 is equal to a length in the second area 22 of the lines of the driver 10 coupling to the first to the M+Rth row pixels through the resistors 220 and a length in the third area 23 of the lines of the driver 10 coupling to the first to the M+Rth row pixels through the resistors 220.

In this embodiment, an amount of the resistors 220 is N. Each column pixels are coupled to the driver 10 through one resistor 220, and the resistances of the first resistors R1 in the N resistors 220 are equal. The resistances of the second resistors R2 in the N resistors 220 are equal. The resistances of the third resistors R3 in the N resistors 220 are equal.

Furthermore, all the resistances of the first resistors R1, the second resistors R2 and the third resistors R3 in the N resistors 230 are gradually increased from the first column and the Nth column respectively to a middle position.

Specifically, as considering the length condition of the connection lines of the driver 10 coupling to the first row pixels of the pixel array 210: the lengths of the lines are gradually decreased from the first column and the Nth column respectively to a middle position. Therefore, all the resistances of the first resistors R1, the second resistors R2 and the third resistors R3 in the N resistors 230 are gradually increased from the first column and the Nth column respectively to a middle position to balance the total resistance of the lines of the driver coupling to the respective row pixels of the pixel array 210 for balancing the charge quantity of the driver 10 to the pixels of the pixel array 210. Therefore, the display brightness of the entire pixel array 210 is balanced.

Specifically, the N columns pixels are symmetric with the pixel array 210 of (M+R) rows×N columns being a central line, and two first resistors R1 coupled with two columns pixels which are mutually symmetric are equal; two second resistors R2 coupled with the two columns pixels which are mutually symmetric are equal; two third resistors R3 coupled with the two columns pixels which are mutually symmetric are equal.

Figure 3:
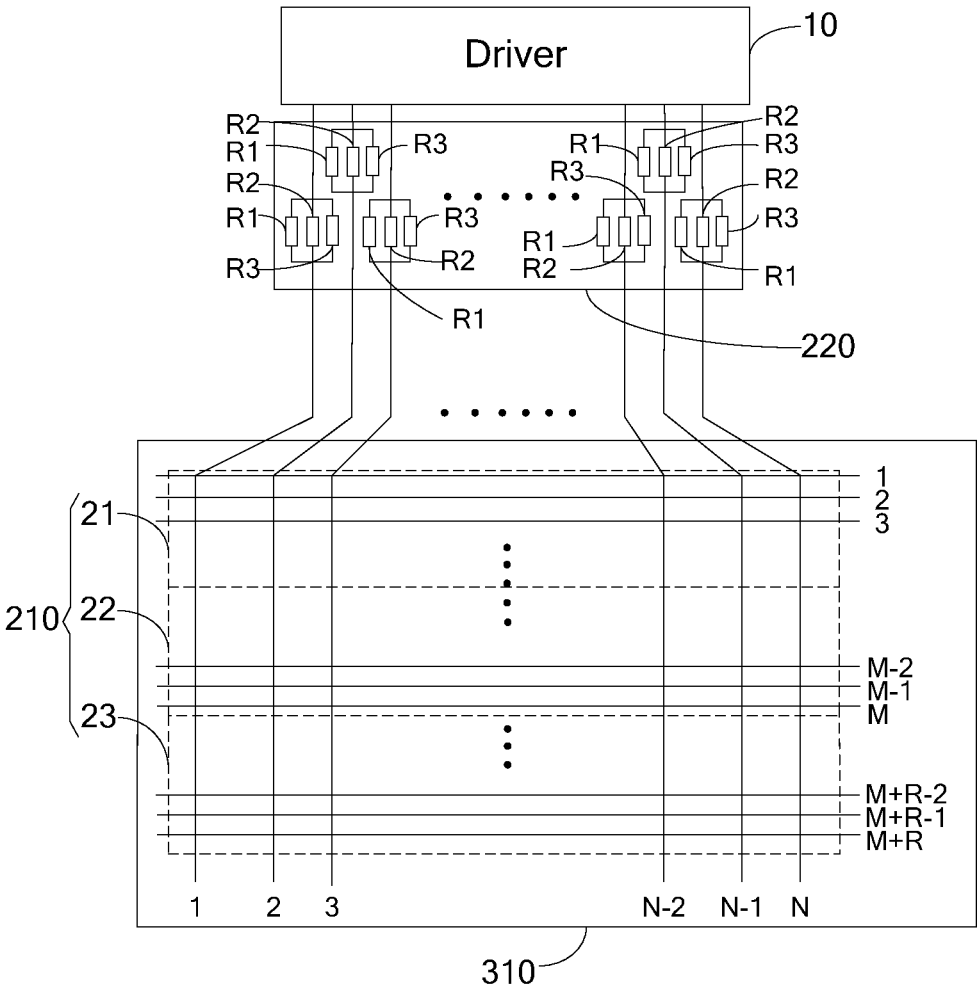
FIG. 3 is a block diagram of a display device provided by the embodiment of the second solution according to the present invention.

Please refer to FIG. 3, a display device 300 provided by the second solution according to the present invention. The display device 300 comprises a display panel 310 and a drive control circuit. The drive control circuit can be the drive control circuit 100 provided by the first embodiment of the first solution or the drive control circuit 200 provided by the second embodiment. In this embodiment, the drive control circuit is the drive control circuit 200 provided by the second embodiment of the first solution. The pixel array 210 of the drive control circuit 200 is located on the display panel 310. The specific structure and function of the drive control circuit 200 have already been described in detail in the aforesaid first solution. The repeated description is omitted here.

In this embodiment, the driver 10 is required to charge each row pixels of the pixel array 210. Because the pixel array 20 comprises a plurality of rows of pixels, the plurality of rows of pixels are sequentially aligned in a form of array to be arranged under the driver 10. The distances of the different rows of pixels with the driver 10 are different. The lengths of the connection lines of the driver 10 with each row pixels are different. Meanwhile, with the distance between the row of the pixels and the driver 10 gets larger and larger, the length of the connection line of the driver 10 with the corresponding row of the pixels also gets longer and longer. The longer the connection is, the larger the connection resistance is, too. Thus, the charging quantity of the driver 10 to the corresponding row of pixels is smaller. Consequently, the charge quantity to the entire pixel array 210 is not even. The display brightness of the entire pixel array 210 becomes uneven. In this embodiment, the drive control circuit 200 comprises a resistor 220. The driver 10 is coupled to the N columns pixels of the pixel array 210 through the resistor 220 to charge the N columns pixels. The resistor 220 comprises a first resistor R1, a second resistor R2 and a third resistor R3. An area surrounded by the pixel array 20 is divided into first to third areas 21-23. All the first area 21 to the third area 23 comprise at least one row pixels. A length of a connection line of the driver 10 with any row pixels in the first area 21 is smaller than a length of a connection line of the driver 10 with any row pixels in the second area 22. A length of a connection line of the driver 10 with any row pixels in the second area 22 is smaller than a length of a connection line of the driver 10 with any row pixels in the third area 23. When the driver 10 determines that it is required to sequentially supply power to each row pixels of the first area 21, the first resistor R1 is activated to make a power supply signal outputted by the driver 10 pass through the first resistor R1 and be sequentially outputted to each row pixels of the first area 21 for sequentially supplying power to the each row pixels of the first area 21. when the driver 10 determines that it is required to sequentially supply power to each row pixels of the second area 22, the second resistor R2 is activated to make the power supply signal pass through the second resistor R2 and be sequentially outputted to each row pixels of the second area 22 for sequentially supplying power to the each row pixels of the second area 22. when the driver 10 determines that it is required to sequentially supply power to each row pixels of the third area 23, the third resistor R3 is activated to make the power supply signal pass through the third resistor R3 and be sequentially outputted to each row pixels of the third area 23 for sequentially supplying power to the each row pixels of the third area 23. Because the resistance of the first resistor R1 is larger than the resistance of the second resistor R2 and the resistance of the second resistor R2 is larger than the resistance of the third resistor R3, the first total resistance (a sum of the corresponding line resistance and the first resistor R1) of the lines of the driver 10 with the pixels in the first area 21 and the second total resistance (a sum of the corresponding line resistance and the second resistor R2) of the lines of the driver 10 with the pixels in the second area 22, the third total resistance (a sum of the corresponding line resistance and the third resistor R3) of the lines of the driver 10 with the pixels in the third area 23 are balanced. Thus, the charge quantity of the driver 10 to the corresponding row pixels is balanced. Therefore, the display brightness of the display device 300 is balanced.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A drive control circuit, comprising a single data driver, a pixel array and at least one first resistor and at least one second resistor, and the pixel array comprises M×N pixels aligned in a form M rows×N columns, and M is a natural number larger than 1, and N is a natural number, and the single data driver is coupled to the N columns pixels of the pixel array through the at least one first resistor and the at least one second resistor to charge the N columns pixels, wherein the at least one first resistor and the at least one second resistor are coupled in parallel between the single data driver and one column pixels and a resistance of the first resistor is larger than a resistance of the second resistor, and an area surrounded by the pixel array is divided into a first area and a second area, and both the first area and the second area comprise at least one row pixels, and a length of a connection line of the single data driver with any row pixels in the first area is smaller than a length of a connection line of the single data driver with any row pixels in the second area, and when the single data driver determines that it is required to sequentially supply power to each row pixels of the first area, the first resistor is selected and activated by the single data driver to make a power supply signal outputted by the single data driver pass through the first resistor and be sequentially outputted to each row pixels of the first area for sequentially supplying power to the each row pixels of the first area, and when the single data driver determines that it is required to sequentially supply power to each row pixels of the second area, the second resistor is selected and activated by the single data driver to make the power supply signal outputted by the single data driver pass through the second resistor and be sequentially outputted to each row pixels of the second area for sequentially supplying power to the each row pixels of the second area to balance charge quantity of the each row pixels.

2. The drive control circuit according to claim 1, wherein the pixel array further comprises R×N pixels aligned in a form R rows×N columns, and the R×N pixels are aligned under the M×N pixels to construct a pixel array of M+R rows×N columns, and the R×N pixels surround a third area, and R is a natural number larger than 1, and a length of a connection line of the single data driver with any row pixels in the third area is larger than the length of the connection line of the single data driver with any row pixels in the second area, and the drive control circuit further comprises at least one third resistor, and the single data driver is coupled to the N columns pixels of the pixel array through the at least one first resistor, the at least one second resistor and the at least one third resistor to charge the N columns pixels, wherein the at least one first resistor, the at least one second resistor and the at least one third resistor are coupled in parallel between the single data driver and the one column pixels, and a resistance of the third resistor is smaller than the resistance of the second resistor, and when the single data driver determines that it is required to sequentially supply power to each row pixels of the third area, the third resistor is activated to make the power supply signal outputted by the single data driver pass through the third resistor and be sequentially outputted to each row pixels of the third area for sequentially supplying power to the each row pixels of the third area to balance charge quantity of the each row pixels in the pixel array of (M+R) rows×N columns.

3. The drive control circuit according to claim 2, wherein a length in the first area of lines of the single data driver coupling to the first to the M+Rth row pixels through the resistors is equal to a length in the second area of lines of the single data driver coupling to the first to the M+Rth row pixels through the resistors and a length in the third area of line of the single data driver coupling to the first to the M+Rth row pixels through the resistors.

4. The drive control circuit according to claim 3, wherein the resistances of the first resistors are equal, and the resistances of the second resistors are equal, and the resistances of the third resistors are equal.

5. The drive control circuit according to claim 4, wherein all the resistances of the first resistors, the second resistors and the third resistors in the N resistors are gradually increased from the first column and the Nth column respectively to a middle position.

6. The drive control circuit according to claim 5, wherein the N columns pixels are symmetric with the pixel array of (M+R) rows×N columns being a central line, and two first resistors coupled with two columns pixels which are mutually symmetric are equal, and two second resistors coupled with the two columns pixels which are mutually symmetric are equal, and two third resistors coupled with the two columns pixels which are mutually symmetric are equal.

7. A display device, comprising a single data driver, a display panel, a pixel array and at least one first resistor and at least one second resistor, and the pixel array comprises M×N pixels aligned in a form M rows×N columns, and M is a natural number larger than 1, and N is a natural number, and the single data driver is coupled to the N columns pixels of the pixel array through the at least one first resistor and the at least one second resistor to charge the N columns pixels, wherein the at least one first resistor and the at least one second resistor are coupled in parallel between the single data driver and one column pixels and a resistance of the first resistor is larger than a resistance of the second resistor, and an area surrounded by the pixel array is divided into a first area and a second area, and both the first area and the second area comprise at least one row pixels, and a length of a connection line of the single data driver with any row pixels in the first area is smaller than a length of a connection line of the single data driver with any row pixels in the second area, and when the single data driver determines that it is required to sequentially supply power to each row pixels of the first area, the first resistor is selected and activated by the single data driver to make a power supply signal outputted by the single data driver pass through the first resistor and be sequentially outputted to each row pixels of the first area for sequentially supplying power to the each row pixels of the first area, and when the single data driver determines that it is required to sequentially supply power to each row pixels of the second area, the second resistor is selected and activated by the single data driver to make the power supply signal outputted by the single data driver pass through the second resistor and be sequentially outputted to each row pixels of the second area for sequentially supplying power to the each row pixels of the second area to balance charge quantity of the each row pixels.

8. The display device according to claim 7, wherein the pixel array further comprises R×N pixels aligned in a form R rows×N columns, and the R×N pixels are aligned under the M×N pixels to construct a pixel array of M+R rows×N columns, and the R×N pixels surround a third area, and R is a natural number larger than 1, and a length of a connection line of the single data driver with any row pixels in the third area is larger than the length of the connection line of the single data driver with any row pixels in the second area, and the display device further comprises at least one third resistor, and the single data driver is coupled to the N columns pixels of the pixel array through the at least one first resistor, the at least one second resistor and the at least one third resistor to charge the N columns pixels, wherein the at least one first resistor, the at least one second resistor and the at least one third resistor are coupled in parallel between the single data driver and the one column pixels, and a resistance of the third resistor is smaller than the resistance of the second resistor, and when the single data driver determines that it is required to sequentially supply power to each row pixels of the third area, the third resistor is selected and activated by the single data driver to make the power supply signal outputted by the single data driver pass through the third resistor and be sequentially outputted to each row pixels of the third area for sequentially supplying power to the each row pixels of the third area to balance charge quantity of the each row pixels in the pixel array of (M+R) rows×N columns.

9. The display device according to claim 8, wherein a length in the first area of lines of the single data driver coupling to the first to the M+Rth row pixels through the resistors is equal to a length in the second area of lines of the single data driver coupling to the first to the M+Rth row pixels through the resistors and a length in the third area of line of the single data driver coupling to the first to the M+Rth row pixels through the resistors.

* * * * *